US008756896B1

(12) United States Patent
Elliott

(10) Patent No.: US 8,756,896 B1
(45) Date of Patent: Jun. 24, 2014

(54) ROOF PANEL FOR PROTECTION AGAINST AIRBORNE THREATS

(71) Applicant: Speciality Hardware L.P., Newport Beach, CA (US)

(72) Inventor: A. Carleton Elliott, Newport Beach, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 0 days.

(21) Appl. No.: 13/732,189

(22) Filed: Dec. 31, 2012

(51) Int. Cl.
*E04H 15/20* (2006.01)

(52) U.S. Cl.
USPC ..... 52/741.3; 52/742.1; 52/2.23; 52/3; 52/202

(58) Field of Classification Search
USPC ..... 52/3, 742.1, 202, 2.11, 2.18, 2.19, 2.22, 52/2.23, 741.3
See application file for complete search history.

(56) References Cited

U.S. PATENT DOCUMENTS

| | | | | |
|---|---|---|---|---|
| 2,252,578 | A * | 8/1941 | Powell | 52/742.13 |
| 2,788,552 | A * | 4/1957 | Miles | 52/407.3 |
| 4,320,605 | A * | 3/1982 | Carlson et al. | 52/94 |
| 5,768,841 | A | 6/1998 | Swartz | |
| 7,637,073 | B2 | 12/2009 | Elliott | |
| 7,658,045 | B2 | 2/2010 | Elliott | |
| 7,770,346 | B2 | 8/2010 | Elliott | |
| 7,866,101 | B2 * | 1/2011 | Boggs, Jr. | 52/202 |
| 7,992,678 | B2 * | 8/2011 | Pilaar | 181/284 |
| 8,056,301 | B2 | 11/2011 | Elliott, Jr. | |
| 8,079,188 | B2 | 12/2011 | Swartz | |
| 8,161,710 | B2 * | 4/2012 | Elliott et al. | 52/745.05 |
| 8,167,710 | B2 | 5/2012 | Agarwal | |
| 8,469,144 | B2 * | 6/2013 | Pilaar | 181/284 |
| 2003/0177705 | A1 * | 9/2003 | Forbis et al. | 52/3 |
| 2011/0225915 | A1 | 9/2011 | Swartz | |

* cited by examiner

*Primary Examiner* — Andrew J Triggs
(74) *Attorney, Agent, or Firm* — Jerry Turner Sewell

(57) ABSTRACT

A roof protection system and a method for constructing the roof protection system for an enclosure provide protection for inhabitants and equipment in the enclosure against projectiles and other falling objects that could impact and penetrate the top of the enclosure. The roof protection system includes roof protection sections wherein each section includes a frame with a plurality of spaces between support beams. A flexible bag of woven para-aramid fiber (e.g., Kevlar® brand fiber) is positioned in each space. Each bag is filled with a selected material such as sand, gravel, cement or other high-strength fill material. First and second outer panels of a non-combustible board laminated to a metallic sheet enclose the flexible bags. The roof protection sections are mounted on support structures so that sections span the top of enclosure and are spaced apart from the top enclosure.

8 Claims, 9 Drawing Sheets

210
300
310
334
550
510
528
550
510
528
550
550
550

ROOF PANEL FOR PROTECTION AGAINST AIRBORNE THREATS

BACKGROUND OF THE INVENTION

1. Field of the Invention

The description and claims in this application are related to systems that protect portable and stationary structures from blast and ballistic events by utilizing airborne threat protection panels that provide protection against many threats from above such as descending explosive projectiles.

2. Description of the Related Art

The roofs of conventional buildings generally do not provide significant safety from falling projectiles such as projectiles from ground-based mortars or projectiles dropped from aircraft. Although permanent structures can be constructed to withstand the impacts and explosions of such projectiles, mobile structures (e.g., mobile command structures, mobile communications facilities, and the like) generally do not have a roof structure capable of withstanding impacts and explosions caused by falling projectiles. Accordingly, when a military force or mobile force enters an area subject to live fire from enemy forces, the personnel must rely on existing unreinforced structures or portable structures that do not provide protection against falling projectiles.

A previous system for protecting the walls of a structure against ballistic projectiles, such as bullets, that strike the walls of the structure is described in U.S. Pat. No. 8,161,710 for "Projectile-Resistant Wall Structure with Internal Bag," which issued on Apr. 24, 2012, and which is incorporated by reference herein.

SUMMARY OF THE INVENTION

In view of the foregoing, a need exists for buildings which can be quickly constructed using conventional techniques and using readily transportable materials.

An aspect of an embodiment disclosed herein is a roof protection system comprising a frame section having first and second end channels, with a plurality of support beams extending between the end channels. Each support beam has a thickness between a respective first side and a respective second side. A first panel is mounted to the respective first sides of the support beams, and a second panel is mounted to the respective second sides of the support beams to form a cavity bounded by the first panel and the second panel and bounded by adjacent support beams. At least one of the first panel and the second panel comprises a sheet of construction material, and a metallic sheet (e.g., steel, aluminum, vanadium, or the like) secured to the sheet of construction material. The roof protection system further includes a bag-like structure secured within each cavity. The bag-like structure comprises at least one sheet of woven, high tensile strength fiber. The bag-like structure has at least a first side facing the first panel and a second side facing the second panel. The first side and the second side are interconnected (e.g., by a respective third side and a respective fourth side and a closed first end section) to form the bag-like structure. The bag-like structure has a flexible cavity defined between the first side and the second side. The flexible cavity of the bag-like structure is filled with a selected material via an open second end section. For example, the selected material is advantageously a granular material. The granular material advantageously comprises a stony material such as, for example, sand, gravel, cement, or other high-strength fill material. Preferably, after filling the cavity, the second end section is closed and secured to retain the selected material within the flexible cavity. In certain preferred embodiments, the at least one sheet of woven, high tensile strength fiber comprises woven para-aramid fiber, such as, for example, Kevlar® brand aramid fiber available from DuPont.

Another aspect in accordance with embodiments disclosed herein is a method of constructing a roof protection system. The method includes constructing a plurality of support beams between first and second end channels to form a frame section having a first side and a second side. The method further comprises mounting a first panel on a first side of the frame section and mounting a second panel on a second side of the frame section to form a plurality of cavities therebetween. At least one of the first panel and the second panel comprises a sheet of construction material and a sheet of metal adhered to the sheet of construction material. The method further includes securing a bag-like structure within each cavity. The bag-like structure comprises at least one sheet of woven, high tensile strength fiber. The bag-like structure is positioned with a first side facing the first panel and with a second side facing the second panel. A first closed edge interconnects the first side and the second side of each bag-like structure, and a second closed edge also interconnects the first side and the second side. The bag-like structure includes a closed first end and an initially open second end. The bag-like structure has a flexible cavity defined between the first side and the second side. In certain embodiments, the method includes filling the flexible cavity of each bag-like structure with a selected material. For example, the selected material is advantageously a granular material. The granular material is advantageously a stony material such as sand or gravel. In certain preferred embodiments, the at least one sheet of woven, high tensile strength fiber comprises woven para-aramid fiber, such as, for example, Kevlar® brand aramid fiber from DuPont.

BRIEF DESCRIPTION OF THE DRAWINGS

The foregoing aspects and other aspects of this disclosure are described in detail below in connection with the accompanying drawing figures in which:

FIG. 20 illustrates an elevational cross-sectional view of the roof protection of FIG. 18 taken along the line 20-20 in FIG. 18; and.

DETAILED DESCRIPTION OF PREFERRED EMBODIMENTS

A roof protection system is disclosed herein with respect to exemplary embodiments. The embodiments are disclosed for illustration of the roof protection system and are not limiting except as defined in the appended claims.

Figure 1:
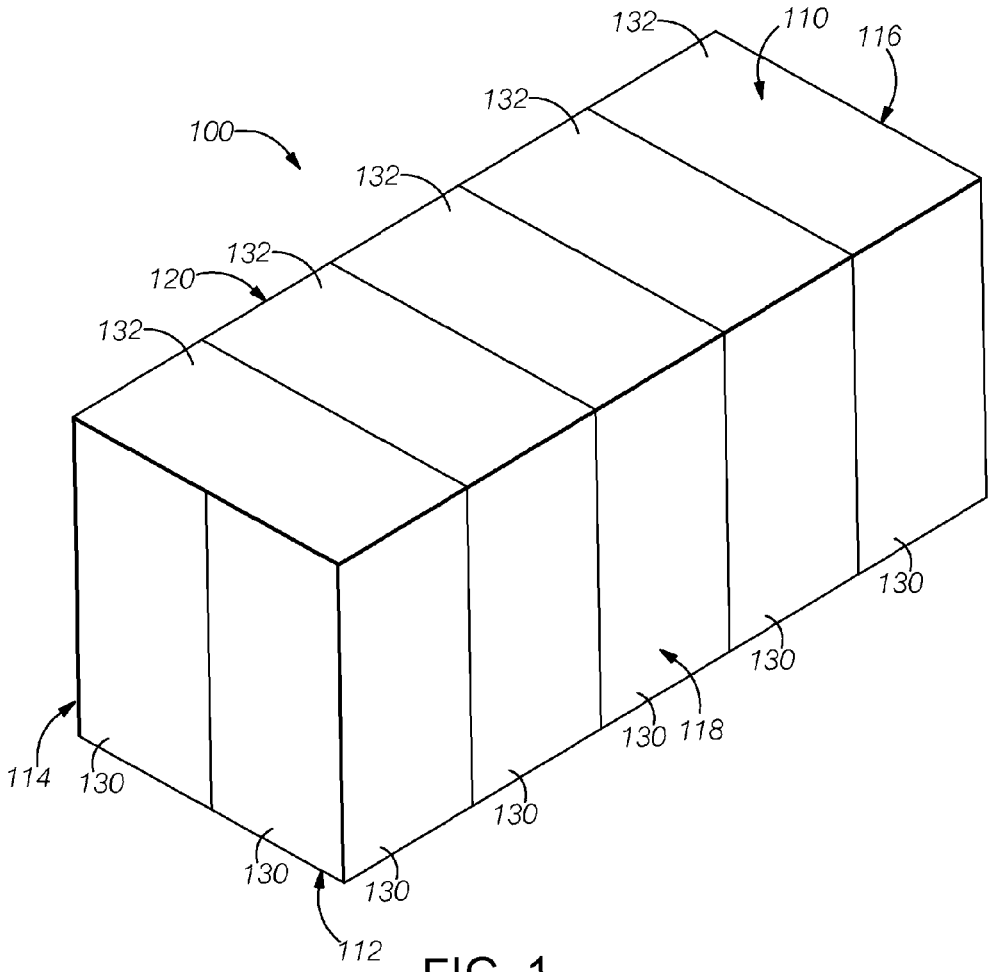
FIG. 1 illustrates a perspective view of a portable enclosure onto which the roof protection system disclosed herein may be attached.

FIG. 1 illustrates a perspective view of a portable enclosure 100 onto which the roof protection system disclosed herein may be attached. As illustrated, the portable enclosure is shaped as a generally rectangular parallelepiped (or cuboid) having all sides and the top and bottom shaped as rectangles. In the illustrated embodiment, the portable enclosure comprises a top surface (roof) 110, a bottom surface (floor) 112 (only two edges of the bottom surface shown), a first end wall 114, a second end wall 116 (only two edges shown), a front wall 118 and a rear wall 120 (only two edges of the rear wall shown).

The illustrated enclosure 100 generally corresponds to the size and shape of a typical intermodal cargo container having nominal dimensions of 8 feet by 8 feet at the first end wall 114 and the second end wall 116, 8 feet by 20 feet for the front wall 118 and the rear wall 102, and 8 feet by 20 feet for the top surface 110 and the bottom surface 112. In the embodiment illustrated in the FIG. 1, the enclosure is modified to include ballistic wall protection on each of its sides and ends by attaching a plurality of wall sections 130, such as, for example, the wall structures described in U.S. Pat. No. 8,161,710 for "Projectile-Resistant Wall Structure with Internal Bag," which issued on Apr. 24, 2012, which is incorporated by reference herein. The top of the enclosure may also be reinforced with horizontally mounted wall sections 132, which may be constructed in accordance with U.S. Pat. No. 8,161,710. Alternatively, the tops and sides of the enclosure may be covered only with a plurality of the laminated steel and cement board panels as disclosed in U.S. Pat. No. 8,161,710. In the illustrated embodiment, the modified enclosure has a length of approximately 20 feet, a width of approximately 8 feet, and a height of approximately 8 feet. It should be understood that the dimensions of the roof protection system described herein can be modified to accommodate containers or other enclosures or structures having greater or smaller dimensions for any of the length, width or height. As further described in the prior patent, the enclosure may be delivered to a location, and the protection panels added to the side and end walls using available materials. Accordingly, the delivery weight of the enclosure is much less than the installed weight of the enclosure. It should be further understood that the roof protection system described herein can be applied to existing structures, such as a stationary building or other enclosure.

For simplicity in the description, entry doors or other access portals to the enclosure 100 are not shown because the present description is directed to the roof protection system described below. For example, one or more of the panels on the first end wall 114 or the second end wall 116 may be provided with hinges and latches to provide access to the interior of the enclosure.

Figure 2:
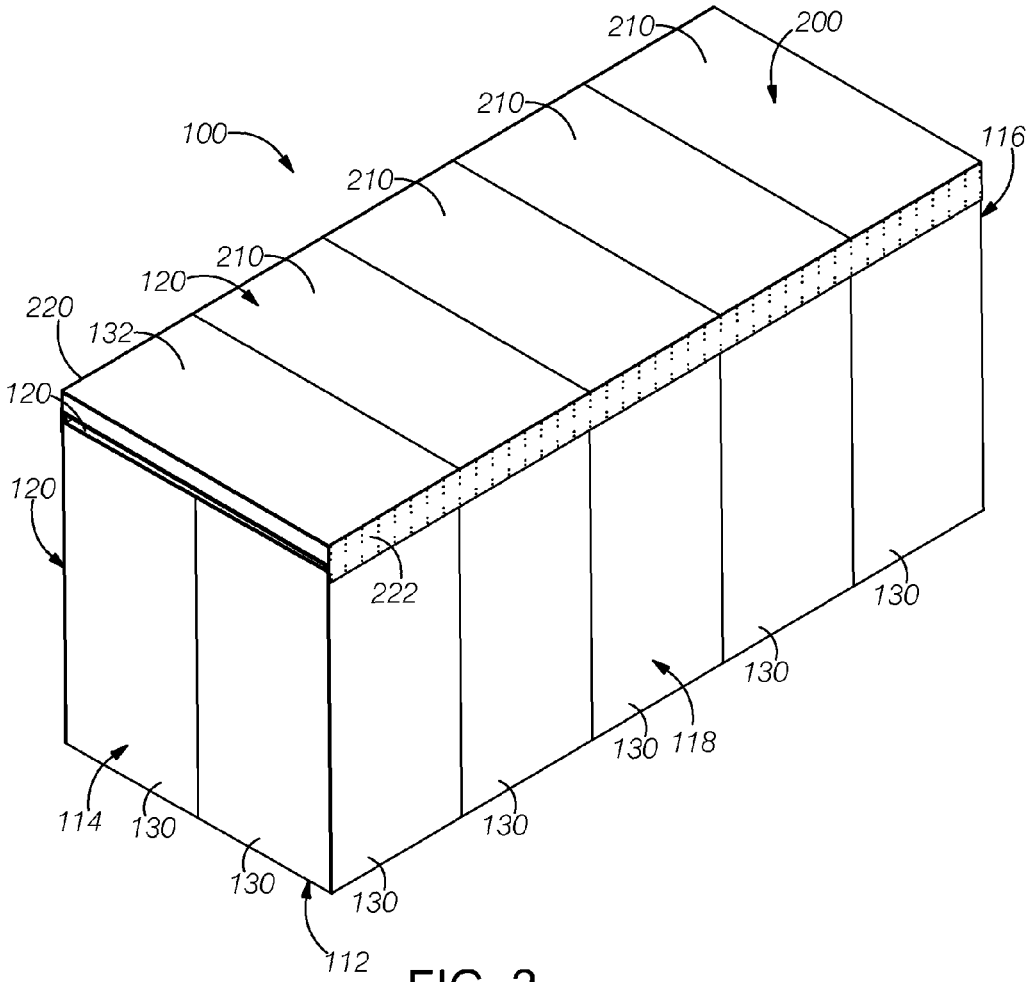
FIG. 2 illustrates a perspective illustration of the portable enclosure of FIG. 2 with the roof protection system attached to the top of the enclosure.

As illustrated in the perspective view of FIG. 2, the basic enclosure 100 of FIG. 1 is modified by adding a roof protection system 200. The roof protection system comprises a plurality of roof protection sections 210. Each roof protection section is supported along the back edge of the top surface 110 and the top edge of the rear wall 120 by a rear support bracket 220. Each roof protection section is supported at the front edge of the top surface and the top edge of the front wall 118 by a front support bracket 222.

Figure 3:
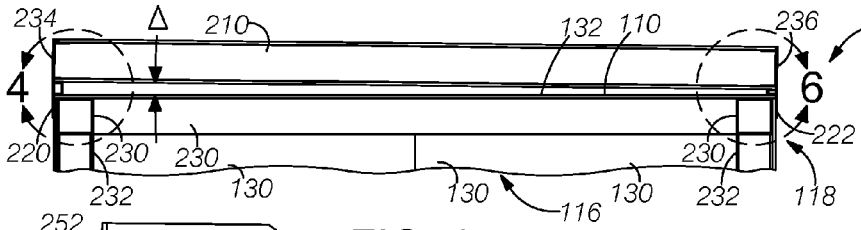
FIG. 3 illustrates a partial elevational end view of the enclosure and roof protection system of FIG. 2 showing an embodiment of a system for mounting the roof protection system to the top of the enclosure, the panels of the first end wall removed in FIG. 3 to show portions of the internal structure of the enclosure.

FIG. 3 illustrates an elevational end view of the enclosure 100 and the roof protection system 200 of FIG. 2 with the panels 130 (FIGS. 1 and 2) of the first end wall 114 of FIG. 2 removed to show a portion of the inner structure of the enclosure, including, for example, internal horizontal support beams 230 and internal vertical support beams 232. The side panels 130 and the top panels 132 are illustrated as the laminated steel and non-combustible board panels (comprising treated wood or other high-strength, non-combustible materials) only rather than the full ballistic wall sections disclosed in the cited patent. Additional internal structures, such as internal wall structures, are not shown in the drawings herein.

As illustrated in FIG. 3, a first end 234 of each roof protection section 210 is supported above the top surface 110 of the enclosure 100 by the rear support bracket 220. A second end 236 of each roof protection section is supported above the top surface by the front support bracket 222.

Figure 4:
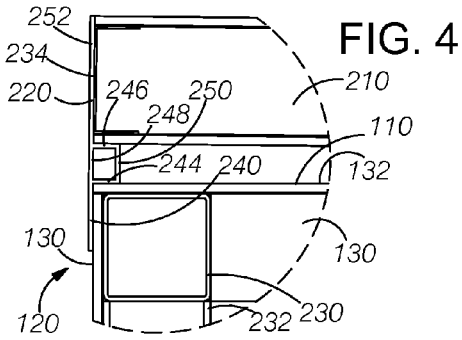
FIG. 4 illustrates an enlarged elevational view of the upper rear portion of the enclosure and roof protection system of FIG. 2 taken within the circular area—4—in FIG. 3.
Figure 7:
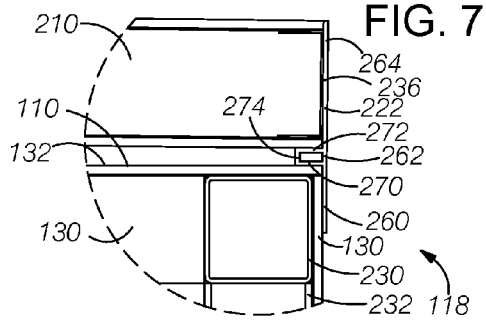
FIG. 7 illustrates an enlarged elevational view of the upper front portion of the enclosure and roof protection system of FIG. 2 taken within the circular area—7—in FIG. 3.
Figure 5:
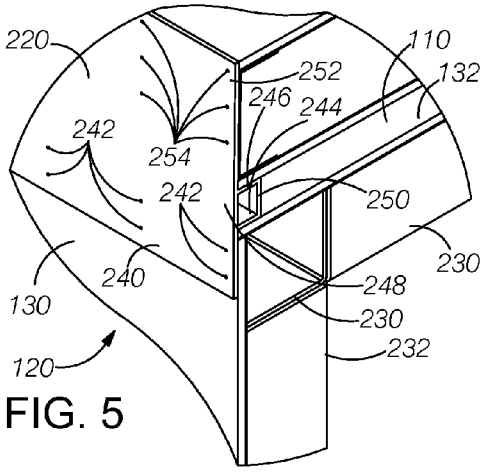
FIG. 5 illustrates an enlarged perspective view of the upper rear corner of the enclosure and roof protection system of FIG. 2, the view generally corresponding to the enlarged elevational view of FIG. 4.

The rear support bracket 220 is shown in more detail in an enlarged elevational view in FIG. 4 and an enlarged perspective view in FIG. 5, which show an upper portion of the rear wall 120 and the first end wall 114. The rear support bracket is shown alone in the further enlarged elevational view of FIG. 6. The rear support bracket comprises a lower engagement portion 240, which is secured to the rear wall via a plurality of suitable engagement devices (e.g., screws) 242 arranged in two rows. The engagement devices are spaced apart along the lower engagement portion by a selected spacing (e.g., 4 four to 6 inches) to assure that the rear support bracket is firmly secured to the rear wall. In one embodiment, the engagement devices comprise #12 or larger sheet metal screws having sufficient lengths to penetrate the underlying rear wall panel 130 to engage the underlying horizontal support beam 230.

The rear support bracket 220 includes a lower rear support ledge 244 that extends generally perpendicularly from the lower engagement portion 240 by a distance of approximately 1.5 inches. The bottom of the lower rear support ledge rests on the top surface 110 of the enclosure 100. The lower rear support ledge transfers the weight of the rear support bracket and the weight at the first end 230 of the roof protection section 210 to the top surface of the enclosure so that the engagement devices 242 are protected from shear forces caused by the weight and caused by impacts and explosions of falling projectiles.

The rear support bracket 220 includes an upper rear support ledge 246 that is spaced apart from the lower rear support ledge 244 by an intermediate portion 248. The bottom surface of the first end 234 of the roof protection section rests upon the top surface of the upper rear support ledge. The intermediate portion of the rear support bracket has a selected length so that the bottom of the first end of the roof protection section 210 is spaced apart from the top surface 110 of the enclosure 100 by a selected distance. For example, in the illustrated embodiment, each of the lower rear support ledge and the upper rear support ledge has a thickness (in the vertical direction) of approximately 0.25 inch. The intermediate portion has a length of approximately 1.75 inches so that the first end of the roof protection section is raised above the top surface by approximately 2.25 inches. In the illustrated embodiment, the lower rear support ledge and the upper rear support ledge are further interconnected at the extended ends by an interconnection portion 250 that forms the support structure into a generally square tubular structure to reduce further bending of the upper and lower rear support ledges.

Figure 6:
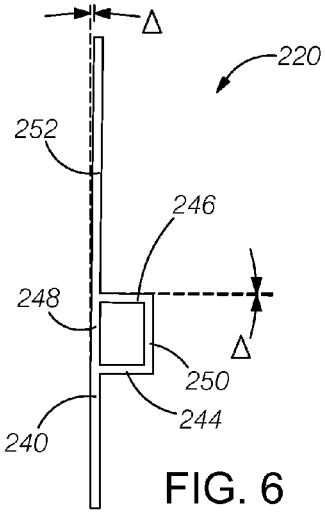
FIG. 6 illustrates an enlarged elevational view of an example of an embodiment of a rear support bracket of FIGS. 3, 4 and 5.

In the illustrated embodiment, the lower engagement portion 240 of the rear support bracket 220 is parallel to the rear wall 120 and is thus generally vertical. Accordingly, the lower rear support ledge 244 is generally horizontal and rests on the top surface 110 as described above. In the illustrated embodiment, the intermediate portion 248 of the rear support bracket extending between the first support ledge and the upper rear support ledge 246 is constructed at a small angle with respect to the lower engagement portion so that the intermediate portion leans inwardly away from the rear wall 120 of the enclosure. For example, in the illustrated embodiment, the intermediate portion leans inwardly by an angle ("Δ") of approximately 0.6 degrees as shown in FIG. 6. Accordingly, the upper rear support ledge, which is approximately perpendicular to the intermediate portion, extends downwardly toward the top surface at a corresponding angle Δ of approximately 0.6 degrees. The roof protection section is positioned on the upper surface of the upper rear support ledge and thus slopes downwardly toward the top surface at a corresponding angle. In alternative embodiments, the intermediate portion is perpendicular, and the roof protection system is positioned in parallel with the top surface of the enclosure.

The rear support bracket 220 extends upwardly from the upper rear support ledge 246 generally in alignment with the intermediate portion by a selected distance to form a second engagement portion 252, which is parallel to and in contact with the first end 234 of the roof protection section 210. In the illustrated embodiment, the second engagement portion has a length of approximately 7.5 inches; however, the length of the engagement portion can be varied. A plurality of suitable engagement devices (e.g., screws) 254, arranged in three rows, secure the upper engagement portion to the first end of the roof protection section. For example, the engagement devices may be spaced apart in each of the rows by approximately four to six inches, and the rows are advantageously spaced apart by approximately 2 inches. Preferably, the engagement devices comprise #12 or larger sheet metal screws.

Figure 8:
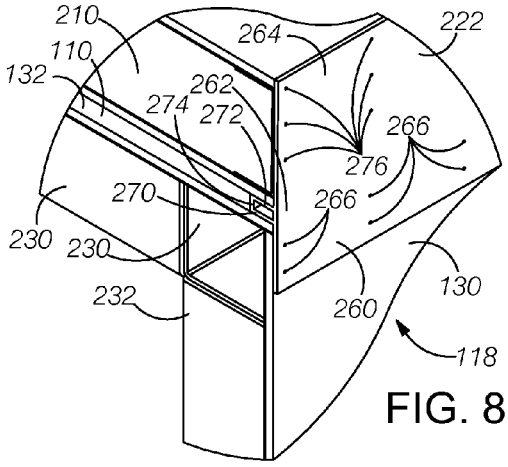
FIG. 8 illustrates an enlarged perspective view of the upper front corner of the enclosure and roof protection system of FIG. 2, the view generally corresponding to the enlarged elevational view of FIG. 7.
Figure 9:
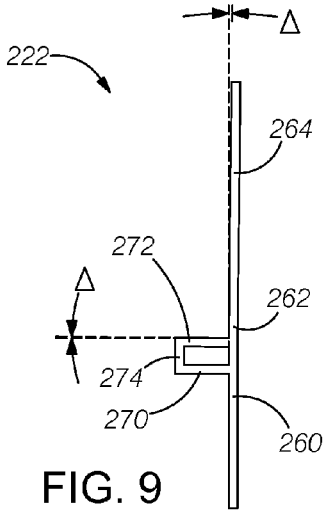
FIG. 9 illustrates an enlarged elevational view of an example of an embodiment of a front support bracket of FIGS. 3, 7 and 8.

The front support bracket 222 is shown in more detail in an enlarged elevational view in FIG. 8 and an enlarged partial perspective view in FIG. 9, which show upper portions of the front wall 118 and the first end wall 114. The front support bracket is shown alone in the further enlarged elevational view of FIG. 9. The front support bracket, which supports the second end 236 of the roof protection section 210, is similar to the rear support bracket 220. The front support bracket includes a lower engagement portion 260, an intermediate portion 262 and an upper engagement portion 264. The lower engagement portion is secured to the front wall 118 by a plurality of suitable engagement devices (e.g., screws) 266 arranged in two rows and spaced apart as described above with respect to the rear support bracket.

A lower front support ledge 270 extends toward the rear wall 120 for approximately 1.5 inches. The lower front support ledge is generally perpendicular to the lower engagement portion 260. In similar manner to the lower rear support ledge, the lower front support ledge transfers weight and other forces at the second end 236 of the roof protection section 210 to the top section 110 of the enclosure 100 to reduce shear forces on the engagement devices 266.

An upper front support ledge 272 of the front support bracket 222 is spaced apart from the lower front support ledge 270 by the intermediate portion 262. Unlike the intermediate portion 248 of the rear support bracket 220, the intermediate portion of the front support bracket has a length of only 0.5 inch. Accordingly. The second end 236 of the roof protection section 210 is spaced apart from the top surface 110 of the enclosure 100 by approximately 1 inch in comparison to the 2.25-inch spacing of the first end 236 of the roof protection section. The extended ends of the lower front support ledge and the upper front support ledge are interconnected by an interconnection portion 274 that forms the support structure into a generally square tubular structure to reduce further bending of the upper and lower rear support ledges. The embodiment of the front support bracket shown in FIG. 9 is compatible with the rear support bracket shown in FIG. 6 to support the roof protection section at an angle with respect to the top surface of the enclosure. In alternative embodiments, the intermediate portion of the front support bracket is perpendicular, and the roof protection system is positioned in parallel with the top surface of the enclosure as discussed above with respect to the rear support bracket.

The second end 236 of the roof protection section 210 is secured to the upper engagement portion 264 of the front support bracket 222 by a plurality of engagement devices (e.g., screws) 276 arranged in rows and spaced apart and sized similarly to the corresponding engagement devices in the upper portion 250 of the rear support bracket 220.

As shown in FIG. 9, the intermediate portion 262 and the upper engagement portion 264 of the front support bracket 222 are also constructed at the small angle Δ (e.g., approximately 0.6 degrees) with respect to the lower engagement portion 260; however, the intermediate portion and upper portion lean outwardly way from the top surface 110. Accordingly, the upper front ledge is angled upwardly away from the top surface at the corresponding angle Δ. The angles by which the upper front support ledge and the upper rear support ledge 246 are selected to be approximately the same so that the upper surfaces of the two upper support ledges are generally in alignment across the top surface of the enclosure and so that the roof protection section rests at an angle of approximately 0.6 degrees to provide drainage from the exposed upper surface of the roof protection section. The small angle Δ of approximately 0.6 degrees allows the upper portions of the two support brackets to be sufficiently close to vertical that substantially the entire top surface of the enclosure is protected by the roof protection section. Furthermore, the difference in length between the panels that form the roof protection system and the panels that form the top surface of the enclosure is very small (e.g., less than 1/32 inch). Thus, similar panels can be used for both purposes as described below.

Figure 10:
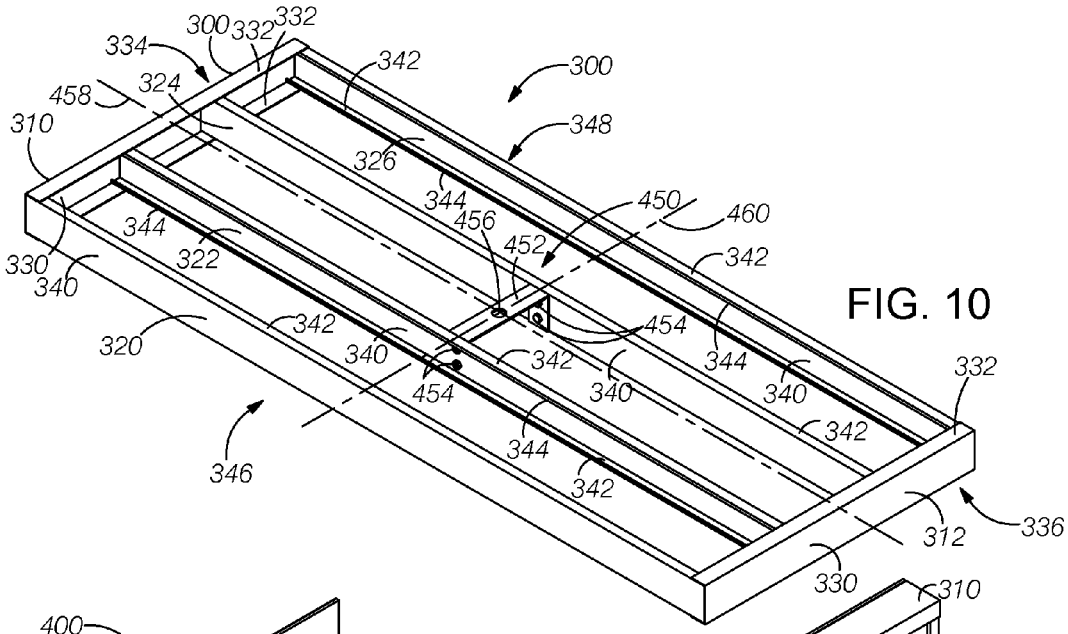
FIG. 10 illustrates a perspective view of a frame for a section of the roof protection system prior to installation of the outer panels and the inner flexible bag, the view showing first and second end members and a plurality of support beams between the end members.

FIG. 10 illustrates a perspective view of a frame 300 for a roof protection section 210 prior to installation of the outer panels and prior to the installation of an inner flexible bag (described below). The frame comprises a plurality of members and beams manufactured from mild steel, vanadium steel, aluminum, or other suitable framing materials. As illustrated, the frame includes a first end member 310 and a second end member 312. The second end member is spaced apart from the first end member to define the length of the frame. The frame further includes a first support beam 320, a second support beam 322, a third support beam 324 and a fourth support beam 326 between the end members. In particular, the support beams are positioned with their respective lengths perpendicular to the end members such that the support beams are mutually parallel to each other.

In the illustrated embodiment, the first and second end members 310, 312 comprise generally rectangular U-shaped channels having a web 330 and two perpendicular flanges 332 extending from each edge of the web. Each end member is positioned with the open side between the flanges directed inwardly so that the open sides face each other across the length of the frame 300. The outer surface of the web of the first end member forms a first end 334 of the frame. The outer surface of the web of the second end member forms a second end 336 of the frame.

In the illustrated embodiment, the webs of the end members have nominal inside widths of approximately 6 inches, and the flanges of the end members have nominal heights of approximately 1.5 inches. The end members have lengths of approximately 48 inches. In the illustrated embodiment, the end members are formed from 12 gauge steel and thus have a thickness of approximately 0.1 inch.

The first, second, third and fourth support beams 320, 322, 324, 326 advantageously comprise C-shaped studs positioned in a generally horizontal orientation. In the illustrated embodiment, each support beam comprises a web 340 and two flanges 342. The two flanges of each support beam are perpendicular to the web. A respective lip 344 extends perpendicularly to each flange such the two lips are substantially parallel to the web of the support beam. In the illustrated embodiment, the web of each support beam has a nominal width of approximately 6 inches, the flanges have nominal heights of approximately 2 inches, and the lips have nominal lengths of approximately 0.5 inch. The support beams have nominal lengths of approximately 96 inches. In the illustrated embodiment, each support beam comprises 12 gauge steel, as described above for the U-channel.

As further illustrated in FIG. 10, a first end of each support beam 320, 322, 324, 226 is inserted into the channel of the first end member 310. A second end of each support beam is inserted into the channel of the second end member 312. When inserted, the respective flanges 342 of the support beams are parallel to and in contact with the flanges 332 of the end members. It should be understood that the nominal 6-inch width of the web 330 of each end member is an inside dimension, and the nominal 6-inch width of the web 340 of each support beam is an outside dimension so that the ends of the support beams fit snugly between the flanges of the end members. The flanges of the support beams are secured to the flanges of the end members by engagement devices (e.g., screws), by welding, or the like, in a conventional manner.

In the illustrated embodiment, the first support beam 320 and the fourth support beam 326 are positioned so that the respective open sides defined by the space between the lips 344 face inwardly toward the center of the frame 300. Similarly, the respective open sides of the second support beam 322 and the third support beam 324 face outwardly away from the center of the frame. One or more of the support beams may be oriented with the respective open side facing in a different direction with respect to the center of the frame. In the illustrated embodiment, the outside surface of the web 340 of the first support beam forms a first side 346 of the frame. The outside surface of the web of the fourth support beam forms a second side 348 of the frame. In the illustrated embodiment, a centerline 350 of the flange 344 of the second support beam is spaced apart from the first side of the frame by a spacing "D." A centerline 352 of the flange of the third support beam is spaced apart from the second side of the frame by the spacing "D." Accordingly, the centerlines of the flanges of the second support beam and the third support beam are spaced apart by 16 inches. In the illustrated embodiment, the spacing "D" is a spacing of approximately 16 inches as conventionally used in building construction. In alternative embodiments, the spacing "D" may be increased (e.g., to 24 inches) by removing one of the support beams or decreased (e.g., to 8 inches) by adding support beams. Other spacing distances may also be used.

Figure 11:
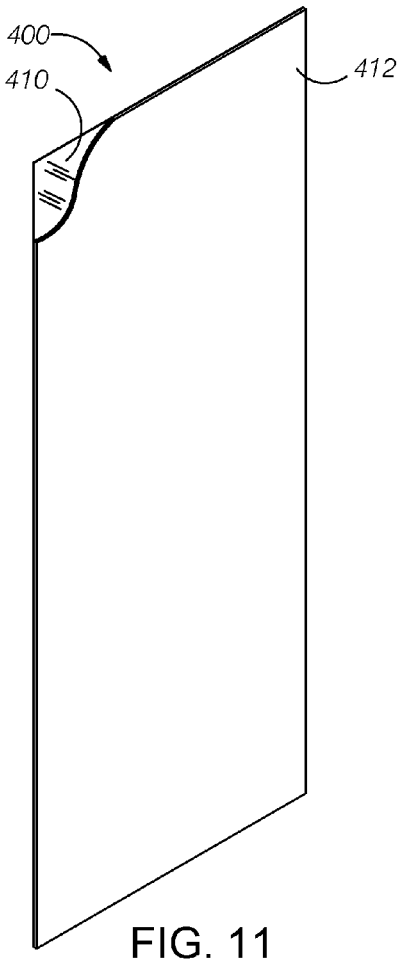
FIG. 11 illustrates a perspective view of an outer panel to be installed on the frame of the roof protection system, the panel comprising a layer of a non-combustible board comprising treated wood or other high-strength material laminated to a metallic sheet such as steel (shown in the broken away portion of the non-combustible board)

FIG. 11 illustrates a perspective view of an outer panel 400 to be installed on the frame of the roof protection system. The outer panel generally corresponds to an inner panel or an outer wall panel illustrated and described in U.S. Pat. No. 8,079,188 for Energy Absorbing Blast Wall for Building Structure, which is incorporated herein by reference. Briefly, the outer wall panel comprises a metallic sheet 410 (e.g., steel) laminated or otherwise secured to a panel of non-combustible board 412 in the manner described in the cited patent. In FIG. 11, a portion of the non-combustible board is broken away to show the underlying sheet of steel. Although described herein as steel, other metallic sheets (e.g., aluminum) may also be used.

In the illustrated embodiment, the non-combustible board 412 has a nominal thickness of approximately 0.5 inch. In certain embodiments, the non-combustible board comprises a non-combustible material such as Durock® brand underlayment available from USG Corporation headquartered in Chicago, Ill.; PermaBase® brand cement board available from National Gypsum Company headquartered in Charlotte, N.C.; and Hardiebacker 500® brand cement backerboard available from James Hardie Building Products in Mission Viejo, Calif. Boards comprising other non-combustible materials may also be used.

The sheet 410 of steel advantageously comprises 14 gauge steel and has a nominal thickness of approximately 0.075 inch. In the illustrated embodiment, the non-combustible board 412 and the sheet of steel have nominal widths of approximately 48 inches and nominal lengths of approximately 121 inches. In alternative embodiments (not shown) the sheet of steel may have a nominal width and a nominal length that are slightly less than the nominal width and nominal length of the non-combustible board to reduce the possibility that an edge of the sheet of steel will be exposed and form a hazard during installation of the outer panel or installation of the completed roof protection section 210.

Figure 12:
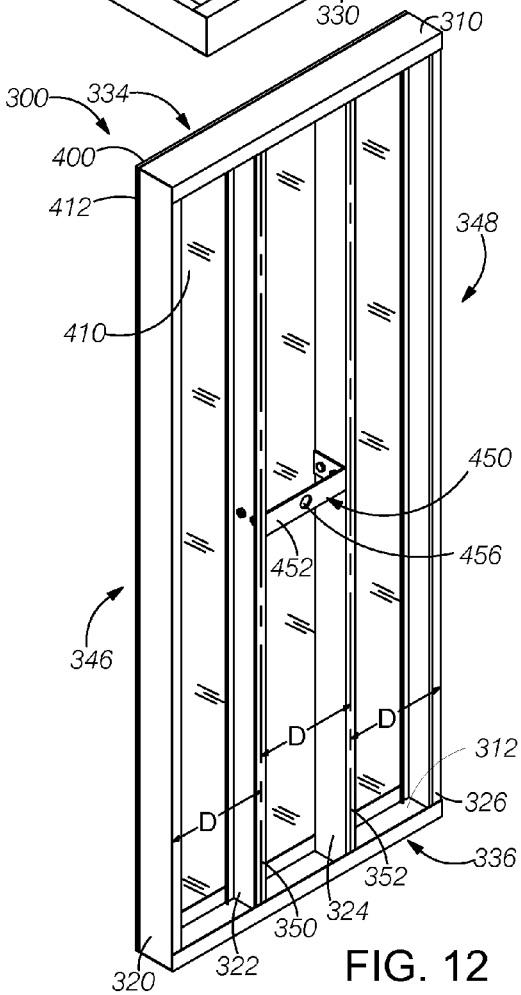
FIG. 12 illustrates a perspective view of the frame of FIG. 10 with an outer panel of FIG. 11 attached to one side of the frame, the frame being rotated to a vertical position in FIG. 12.

As shown in FIG. 12, the outer panel 400 is oriented with the sheet 410 of steel adjacent to and in contact with the flanges 332 of the end members 310, 312 and the flanges 344 of the support beams 320, 322, 324, 326. The outer panel is attached to the end members and to the support beams of the frame 300 using suitable fasteners, such as, for example, screws (not shown), in the manner described in the cited patents. A second outer panel (not shown in FIG. 12) is attached to the exposed flange members. The order in which the outer panels are installed is discussed below.

In certain embodiments (not shown) a self-sealing material can be attached to the exposed surface of the steel sheet 410 that contacts the support beams 320, 322, 324, 326. The self-sealing material advantageously comprises a butyl rubber material such as, for example, the material used in self-sealing vehicle tires. The sheet of self-sealing material is attached to the metal sheet by a suitable adhesive or other suitable attachment material. The self-sealing material may reduce the leakage of the filler material (described below) in the event of a small puncture of the outer panel 400 and a corresponding puncture of an inner flexible bag (also described below).

As further shown in FIGS. 10 and 12, the frame 300 includes a lift attachment device 450 that is positioned approximately at the center of the frame. As shown in FIG. 10, the lift attachment device includes a bracket 452 secured to the webs 340 of the second support beam 322 and the third support beam 324 by a plurality of fasteners 454 such as for example bolts and nuts (as shown) or other suitable fastening systems. The bracket includes a threaded bore 456 that is positioned substantially in the center of the frame at the intersection of a vertical centerline 458 and a horizontal centerline 460. The threaded bore is threaded to receive an eyebolt or other fastener (described below).

Figure 13:
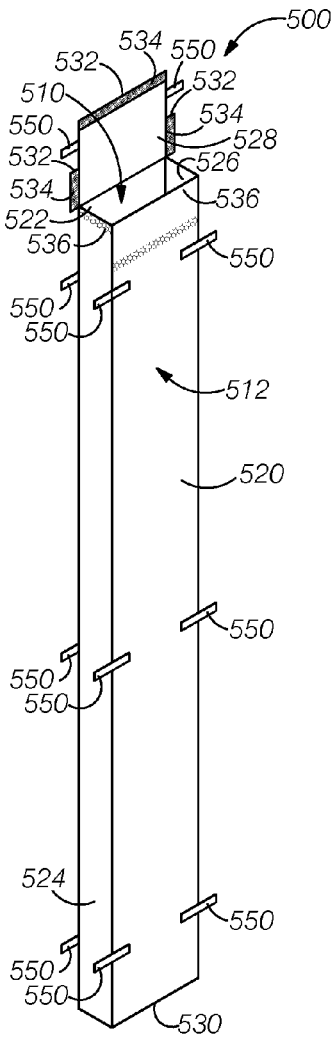
FIG. 13 illustrates a perspective view of a flexible bag having an open first end to show an empty inner cavity prior to filling with a protective material.
Figure 14:
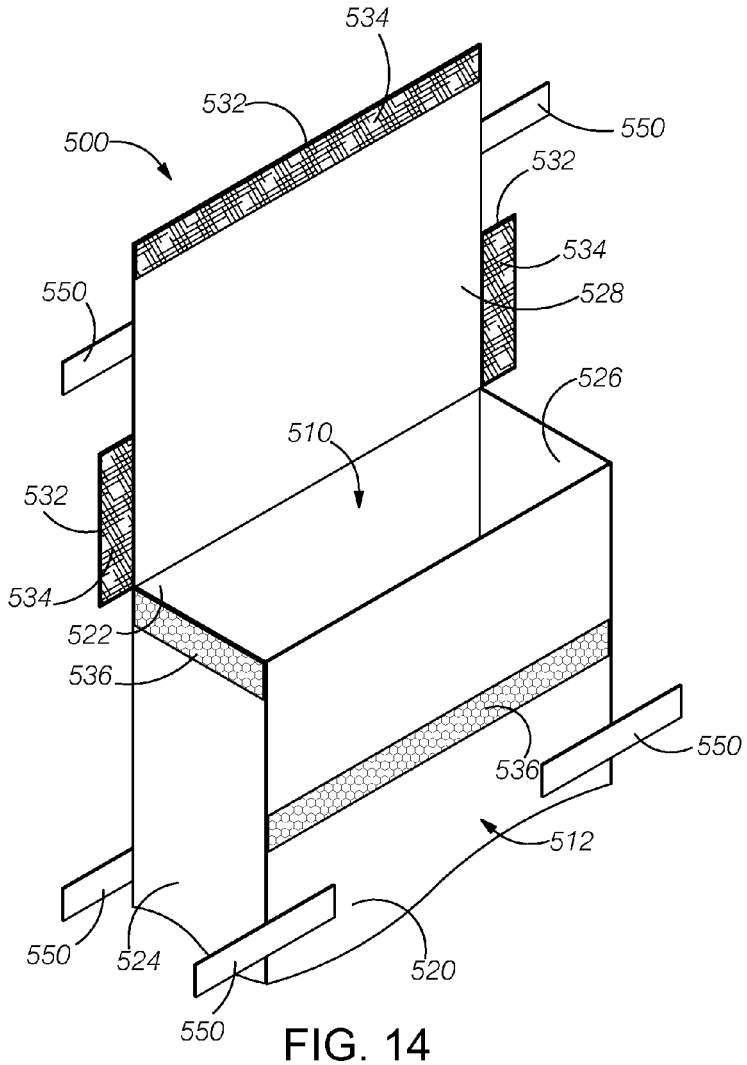
FIG. 14 illustrates an enlarged perspective view of a first (upper) portion of the flexible bag of FIG. 11 showing the hook-and-loop pairs (or other closure device) on the flaps and the sides of the bag for closing and securing the first end after filling the bag.

FIG. 13 illustrates a perspective view of a flexible bag 500 having an empty inner cavity 510. The flexible bag comprises at least one sheet 512 of a woven, high tensile strength fiber. For example, in the illustrated embodiment, the sheet comprises a woven para-aramid fiber, such as, for example, Kevlar® brand aramid fiber from DuPont. The flexible bag may comprise a single sheet formed into a bag in the manner described in FIGS. 14-19 of U.S. Pat. No. 8,161,710. Alternatively, the flexible bag may be formed as a more box-like structure as illustrated in FIG. 13 herein. For example, the flexible bag may advantageously comprise a front side 520, a rear side 522, a left side 524, a right side 526, a first end 528, and a second end 530 (see FIG. 15). The embodiment of the flexible bag illustrated in FIG. 11 may be formed from a single sheet cut into a pattern that can be closed to form the box-like structure, or the bag may be formed from multiple sheets that are interconnected to form the structure. In either case, each seam formed to interconnect sheets or edges of the same sheet is preferably reinforced with reinforcing material (not shown) as described in the cited patent.

As shown in the embodiment of FIG. 13, the first end 528 of the flexible bag 500 may be initially left open. The open end allows the inner cavity 510 of the flexible bag to be filled with a suitable material (as described below) to increase the ballistic protection provided by the woven, high-tensile strength sheet 512 that forms the structure of the bag. After filling, the bag is closed to seal the material within the inner cavity. For example, as shown in the enlarged perspective view of an upper portion of the bag in FIG. 14, the first end of the bag advantageously comprises a plurality of flaps 532 with attached segments 534 of the hook (or loop) portions of hook-and-loop fastening pairs. The uppermost portions of the front side 520, the left side 522 and the right side 524 of the bag include attached segments 536 of the mating loop (or hook) portions of the hook-and-loop fastening pairs. Hook-and-loop fastening pairs are commercially available as Velcro® brand hook-and-loop fasteners from Velcro USA and as similar fasteners from other sources. Other fastening structures may also be used.

Figure 15:
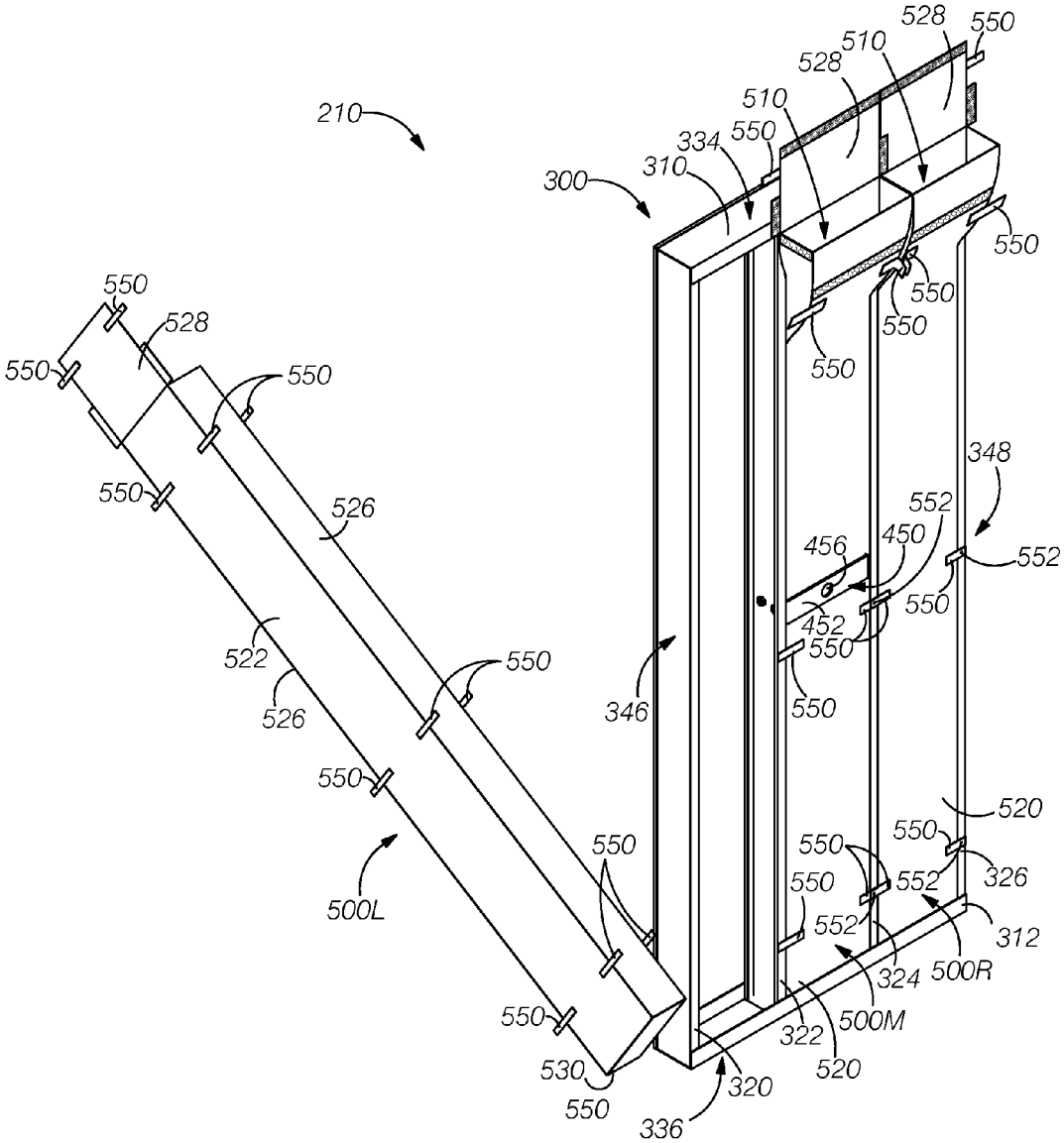
FIG. 15 illustrates a perspective view of the frame and first outer panel of FIG. 12 with two of the flexible bags of FIG. 13 positioned in respective cavities between respective adjacent support beams and with the third flexible bag yet to be positioned and shown in a rear perspective view, the views showing the first ends of each bag being open to provide access to the inner cavity of each bag.

In the illustrated embodiment, the inner cavity is filed with a granular material, such as, for example, sand or gravel. Sand, for example, is readily available throughout the world and is quite plentiful in desert areas where the transportable enclosure 100 may be used. Although the flexible bag 500 may be pre-filled with the granular material prior to insertion into the spaces between adjacent support beams 320, 322, 324, 326, in the illustrated embodiment, an empty flexible bag is positioned in each space between adjacent support beams 320, 322, 324, 326 of the frame 300 as illustrated in FIG. 15. In FIG. 15, an open right bag 500R and an open middle bag 500M are positioned in the frame. An open left bag 500L is shown prior to being rotated and then positioned in the frame. Each bag is initially adjusted to substantially fill the respective space. To assist in this procedure, the front side 520, the rear side 522, and the first end 528 of each bag may have selected lengths of nylon straps 550 attached thereto. The straps are spaced apart on the front side and the back side and extend outward from the left side 524 and the right side 526 of the bag. For example, in the illustrated embodiment, three straps extend outwardly from each edge of the front side of the bag and three straps extend outwardly from each edge of the rear side of the bag for a total of 12 straps. Two additional straps extend outwardly from the first end of the bag. When positioned in the frame as shown in FIG. 15, the straps are secured to the flanges 342, 344 of the support beams. For example, the straps from two adjacent bags may be overlapped and secured to the flanges of the support beams by screws 552 or other fastening systems. After securing the straps, any excess strap material may be discarded. In certain embodiments, the bags are inserted into the frame before installing the first outer panel 400 shown in FIG. 12 so that the straps on the rear sides of the bags may be secured to the support beams of the frame before installing the first outer panel to the frame. As further shown in FIG. 15 for the middle bag and the right bag, an upper portion of each of the open bags proximate the first end is initially pulled out of the respective cavity in the frame so that the open top is accessible as described below.

Figure 16:
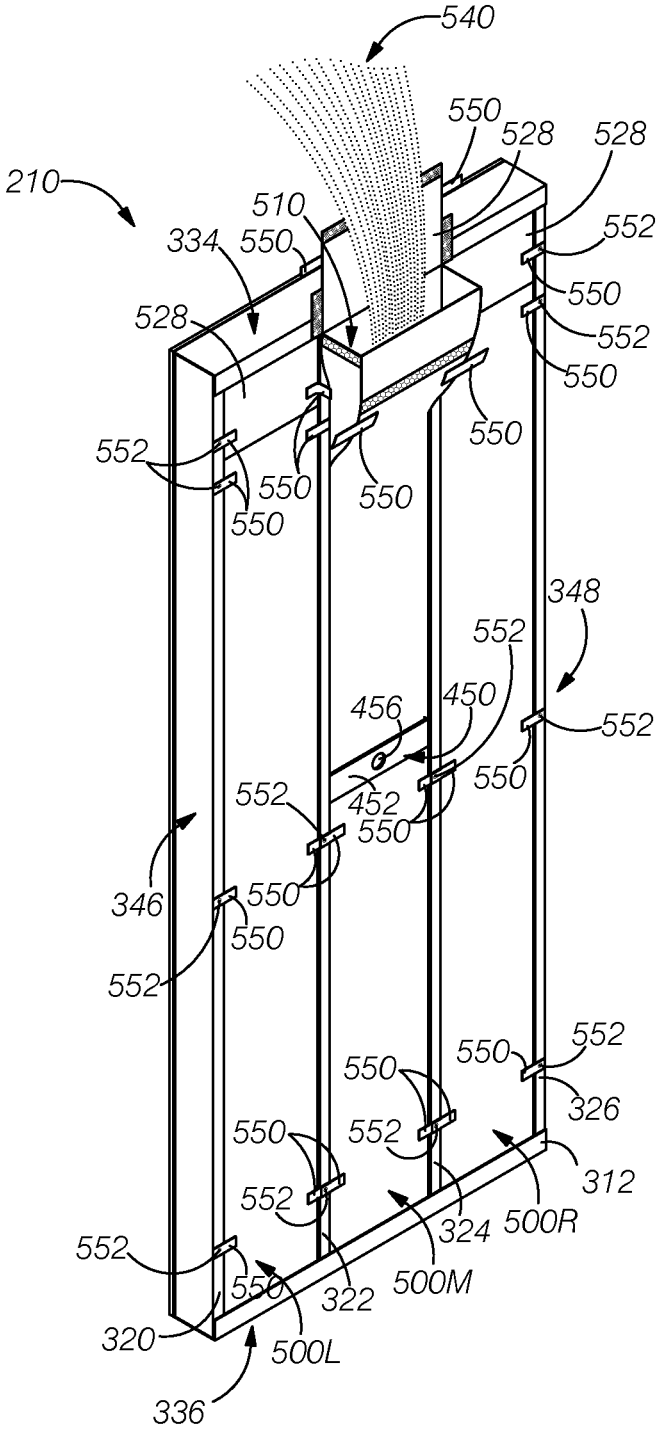
FIG. 16 illustrates a perspective view of the frame and flexible bags of FIG. 15, the view showing the two outer bags filled and fully aligned within the frame and further showing the middle bag in the process of being filled with a granular material.

In FIG. 16, the three bags 500L, 500M, 500R are positioned in the frame 300 with the frame positioned generally vertically. The left bag and the right bag are filled with granular material, and the respective first ends are closed using the hook-and-loop closing pairs. The first ends are inserted fully into the respective spaces of the frame with the first ends pushed up against the first end member 310 of the frame. In FIG. 16, the first end 528 of the middle bag remains outside the cavity and is open to provide access to inner cavity 510 for inserting the granular material 540. The granular material may be added to the inner cavity of the middle bag manually or using a mechanical system (not shown). Accordingly, the granular material is represented in FIG. 15 as a generalized flow into the cavity. In alternative methods of filling the inner cavities of the bags, the bags may be positioned fully within the frame with the first ends open. The first end member may be temporarily removed to provide access to the cavities. After filling the cavities and securing the first ends, the first end member is secured to the support beams 320, 322, 324, 326.

Figure 17:
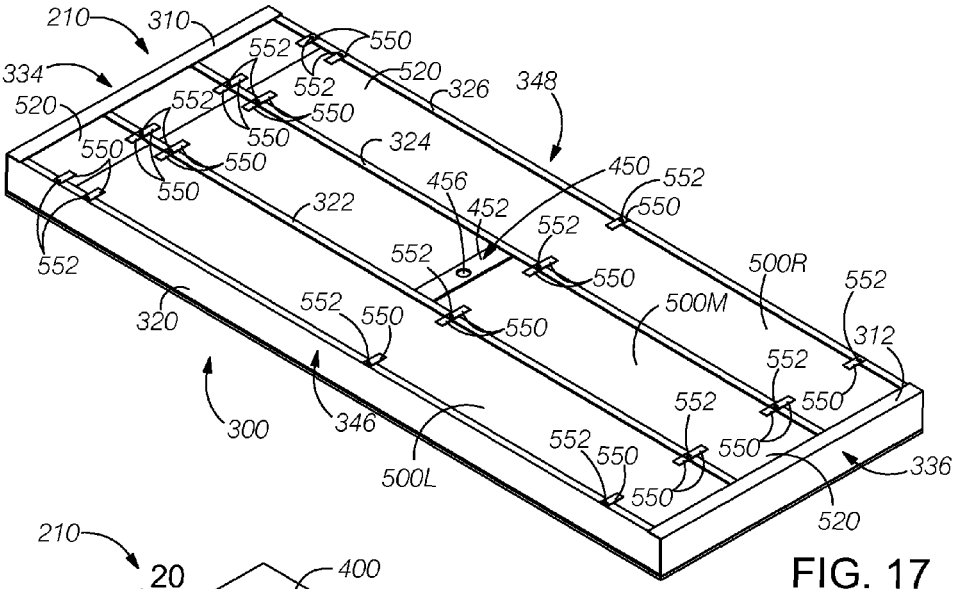
FIG. 17 illustrates a perspective view of the frame and the flexible bags of FIG. 15 after the three bags are filled and closed and inserted fully between the support beams of the frame, the view showing the frame prior to the attachment of the second outer panel.
Figure 18:
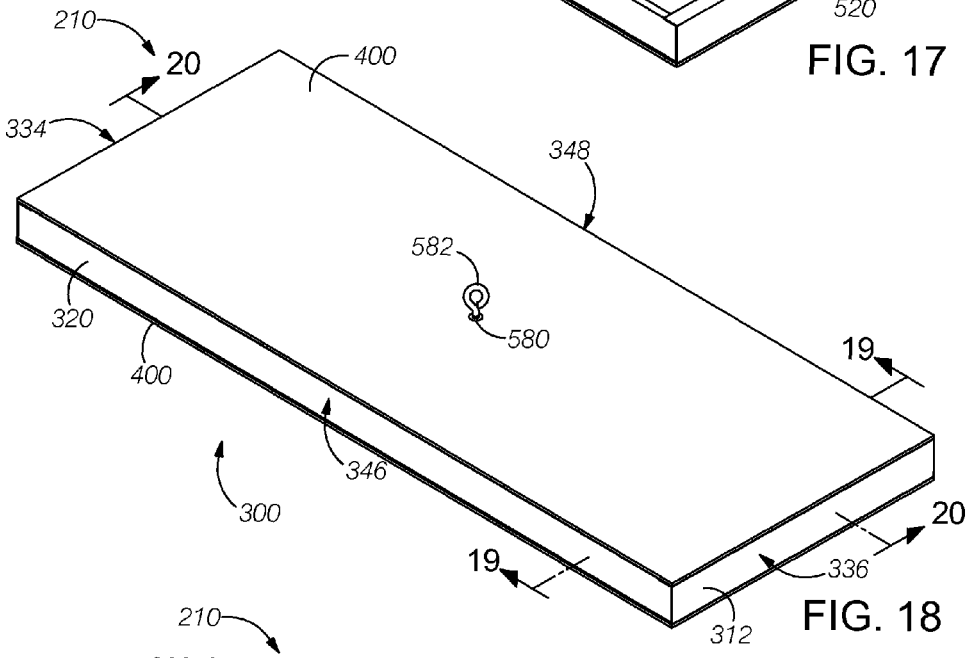
FIG. 18 illustrates a perspective view of the completed roof protection section after installation of the second outer panel onto the support beams and showing an eyebolt secured to the roof protection section.
Figure 19:
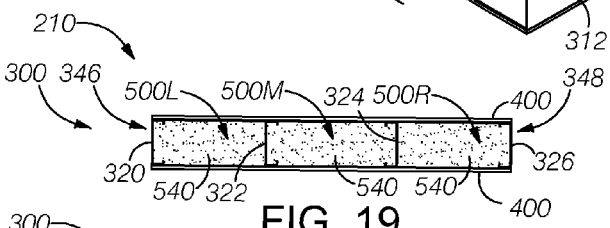
FIG. 19 illustrates an front elevational cross-sectional view of the roof protection of FIG. 18 taken along the line 19-19 in FIG. 18.
Figure 20:
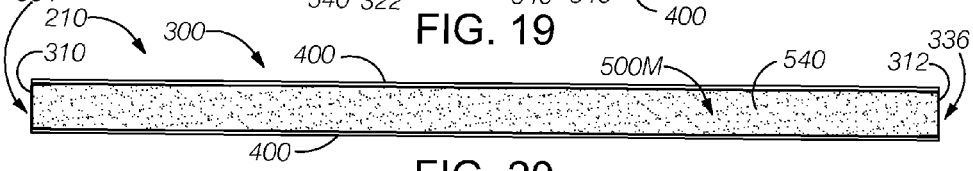

When the middle bag is filled, the top of the middle bag is closed and inserted into the cavity, and the frame with the filled bags is laid in a generally horizontal position as shown in FIG. 17. The grains of sand tend to evenly fill the cavity and to pack into a dense mass; however, if any portion of the front surface 520 any of the bags extends above the plane of the flanges of the support beams 320, 322, 324, 326, the exposed front surfaces may be rolled or tamped to redistribute any granular material within the bags to position all portions of the bags below the plane of the flanges. A second outer panel 400 is then positioned over the support beams and secured to the support beams, the first end member 310 and the second end member 312 as shown in FIG. 18. The second outer panel is also installed with the steel sheet 410 adjacent to the flanges of the support beams. As illustrated in FIG. 18, the second outer panel preferably includes a through bore 580. The bore is centered vertically and horizontally on the face of the panel so that when the second panel is secured to the frame, the bore of the panel is aligned with the threaded bore 456 of the lift attachment device 450. Accordingly, an eyebolt 582 or other engagement device is threaded into the threaded bore via the through bore. At this stage, the roof protection section 210 is completed and ready to be installed on the enclosure 100. As illustrated in a cross-sectional view in FIG. 19, taken along the lines 19-19 in FIG. 18 and in the cross-sectional view in FIG. 20 taken along the lines 20-20 in FIG. 18, the granular material 540 substantially fills the space between the first end member 310 and the second end member 312 and the spaces between adjacent support beams 320, 322, 324, 326.

After the roof protection sections 210 are completed, each roof protection section is lifted using the eyebolt 582 engaged with the lift attachment device 450 via a cable 600 from a crane (not shown) or other lifting system. Each roof protection section is secured to the rear support bracket 220 and the front bracket 222 as illustrated for an installed roof protection section in FIG. 21. After each panel is installed, the eyebolt can be removed and a threaded insert (not shown) can be inserted into the threaded bore 456 of the lift attachment device to seal the upper surface of the panel.

Figure 21:
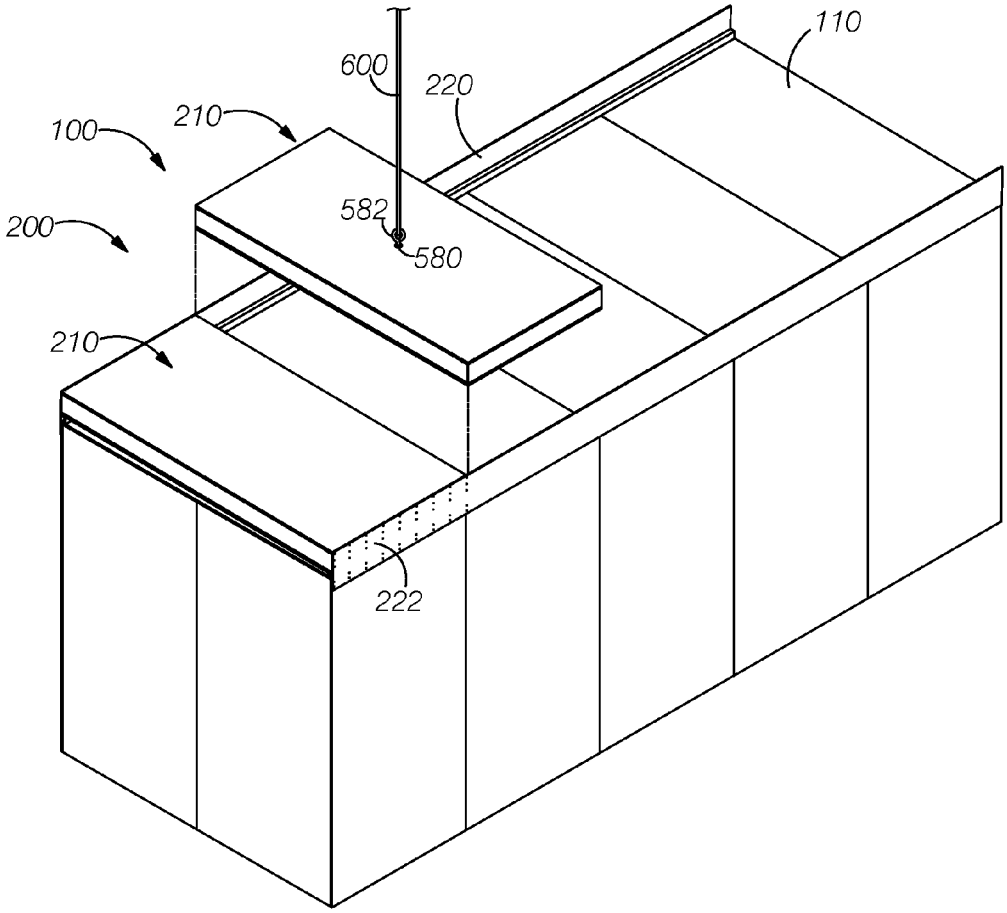
FIG. 21 illustrates a perspective view of the enclosure of FIG. 2, the view in FIG. 21 showing the completed installation of a roof protection section onto the front and rear support brackets and further showing a second roof protection section being lowered to the support brackets.

In an alternative embodiment (not shown), the first end 528 of the flexible bag 500 can also be closed before filling. In such an embodiment, the first end includes an opening that is aligned with a corresponding opening in the first end member 310 using lengths of the hook-and-loop pairs to aid in positioning the openings. After installing the flexible bags in the spaces and installing a second outer panel 400, the completed frame 300 is positioned in a substantially vertical position so that the granular material 540 may be inserted into the inner cavities of the bags via funnels or other conduits through the aligned holes. Thereafter, the aligned holes are sealed with a suitable material (e.g., adhesive tape or the like). When the completed roof protection section is positioned on and secured to the rear support bracket 220 and the front support bracket 222, as shown in FIG. 21, the second engagement portion 250 of the rear support bracket will overlay the sealed opening in the first end member and assure that no granular material is discharged through the opening.

The combination of the laminated outer panels 400, the flexible bag 500 of woven, high-tensile strength material and the granular filler material 540 provides significant protection against the impact and explosion of falling projectiles on the roof of the enclosure 100. The structure of the roof protection sections 210 allow the sections to be delivered to a site completely assembled with the empty flexible bags therein so that the shipping weight of the roof protection sections does not include the weight of the granular filler. The granular filler is added on site during the installation process. If the enclosure needs to be moved, the filler may be removed from the roof protection sections to reduce the weight, and then added again at a new site.

One skilled in art will appreciate that the foregoing embodiments are illustrative of the present invention. The present invention can be advantageously incorporated into alternative embodiments while remaining within the spirit and scope of the present invention, as defined by the appended claims.

I claim:

1. A method of constructing a system for protecting a top of an enclosure from falling objects, the method comprising:

attaching a first support structure to a first edge of the enclosure proximate to the top of the enclosure;

attaching a second support structure to a second edge of the enclosure proximate to the top of the enclosure, the second support structure generally parallel to the first support structure;

constructing a plurality of roof protection sections, each roof protection section comprising a frame having a first end channel and a second end channel and a plurality of parallel support beams, each support beam extending from the first end channel to the second end channel, each support beam and an adjacent support beam forming a pair of adjacent support beams, wherein constructing a plurality of roof protection sections comprises:

attaching a first panel to the frame, the first panel attached to each of the support beams along a first side of the frame;

inserting a flexible bag comprising woven, high-tensile strength fiber between the support beams in each pair of adjacent support beams, each flexible bag extending substantially between the first end channel and the second end channel;

filling each flexible bag with a selected material and closing each flexible bag; and attaching a second panel to the frame, the second panel attached to each of the support beams along a second side of the frame;

and mounting the roof protection sections between the first support structure and the second support structure with the first end channel of each roof protection section secured to the first support structure and with the second end channel of each roof protection section secured to the second support structure.

2. The method of claim 1 wherein the support structures are configured to space a lower surface of each roof protection section apart from the top of the enclosure.

3. The method of claim 2, wherein the first support structure spaces the first end of the frame section apart from the top of the enclosure by a first distance, and the second support structure spaces the second end of the frame section apart from the top of the enclosure by a second distance, wherein the second distance is less than the first distance such that the frame section at an angle with respect to the top of the enclosure.

4. The method of claim 2, wherein the frame section is parallel to the top of the enclosure.

5. The method of claim 1, wherein the selected material is a granular material.

6. The method of claim 5, wherein the granular material comprises a stony material.

7. The method of claim 6, wherein the stony material comprises one or more of sand, gravel, cement or other high-strength fill material.

8. The method of claim 1, wherein the at least one sheet of woven, high tensile strength fiber comprises woven para-aramid fiber.

* * * * *